US007234453B2

(12) United States Patent
Gallino et al.

(10) Patent No.: US 7,234,453 B2
(45) Date of Patent: Jun. 26, 2007

(54) MULTIFUNCTIONAL MODULE, MOTOR VEHICLE COMPRISING SUCH A MODULE AND PROCESS FOR MANUFACTURING SUCH A MODULE

(75) Inventors: Marco Gallino, Torino (IT); Anthony Alves, Strasbourg (FR); Jacques Vetois, Duttlenheim (FR)

(73) Assignee: Mark IV Systemes Moteurs (SAS), Courbevoie (FR)

( * ) Notice: Subject to any disclaimer, the term of this patent is extended or adjusted under 35 U.S.C. 154(b) by 0 days.

(21) Appl. No.: 11/228,287

(22) Filed: Sep. 19, 2005

(65) Prior Publication Data

US 2006/0207578 A1 Sep. 21, 2006

(30) Foreign Application Priority Data

Sep. 20, 2004 (FR) ..... 04 09923

(51) Int. Cl.
*F02M 25/07* (2006.01)
*F02B 47/08* (2006.01)
*F01P 1/06* (2006.01)

(52) U.S. Cl. ..... 123/568.12; 123/41.31

(58) Field of Classification Search ..... 123/41.08, 123/41.31, 568.11, 568.12, 568.17, 568.18, 123/184.21, 563; 60/599, 605.2
See application file for complete search history.

(56) References Cited

U.S. PATENT DOCUMENTS 4,134,377 A * 1/1979 Bamsey et al. ..... 123/568.12
5,732,688 A * 3/1998 Charlton et al. ..... 123/568.12
5,970,960 A * 10/1999 Azuma ..... 123/568.12
6,116,026 A * 9/2000 Freese, V ..... 60/605.2
6,186,127 B1 * 2/2001 Everingham ..... 123/568.12
6,237,547 B1 * 5/2001 Ishiyama ..... 123/568.12
6,311,678 B1 * 11/2001 Lepoutre ..... 123/568.12

(Continued)

FOREIGN PATENT DOCUMENTS

DE 10119484 10/2002

(Continued)

OTHER PUBLICATIONS

English Language Abstract of JP 2000-008973.

*Primary Examiner*—Willis R. Wolfe, Jr.
(74) *Attorney, Agent, or Firm*—Greenblum & Bernstein, P.L.C.

(57) ABSTRACT

A multifunctional module for internal combustion engine, forming a structural assembly and incorporating the functions of exhaust gas cooling and regulation, at least in part, of the circulation flows in said engine's cooling circuit, comprising a first functional unit incorporating, on the one hand, a part at least of an exhaust gas recirculation circuit and a heat exchanger for cooling the gases, preferably of elongated form, together with at least one gas flow regulation/diversion component, and, on the other hand, a part at least of the engine cooling circuit, with at least the water outlet casing and a thermostatic component for regulating the flow therein; the structural assembly comprises a second functional unit in the form of a substantially flat, plate-shaped body, consisting of a stiffening and fixing plate for the first functional unit and a thermal isolation interface between the first functional unit and the engine block; the plate-shaped body comprises on one of its faces sites for fitting and fixing the first functional unit and on the other face sites for fitting and fixing on the engine block.

24 Claims, 12 Drawing Sheets

U.S. PATENT DOCUMENTS

| | | | | |
|---|---|---|---|---|
| 6,360,532 | B2 * | 3/2002 | Strahle et al. | 123/568.12 |
| 6,513,507 | B2 * | 2/2003 | Balekai et al. | 123/568.17 |
| 6,647,971 | B2 * | 11/2003 | Vaughan et al. | 123/568.12 |
| 6,976,480 | B2 * | 12/2005 | Miyoshi et al. | 123/568.12 |
| 7,108,193 | B2 * | 9/2006 | Ieda | 123/568.12 |
| 2005/0145228 | A1 * | 7/2005 | Ieda | 123/568.12 |
| 2005/0199381 | A1 * | 9/2005 | Mercz et al. | 123/568.12 |

FOREIGN PATENT DOCUMENTS

| | | |
|---|---|---|
| DE | 10321638 | 1/2004 |
| JP | 2000-008973 | 1/2000 |
| WO | 01/20156 | 3/2001 |

* cited by examiner

MULTIFUNCTIONAL MODULE, MOTOR VEHICLE COMPRISING SUCH A MODULE AND PROCESS FOR MANUFACTURING SUCH A MODULE

The present invention relates to the field of motor vehicle parts and accessories, more particularly peripheral or secondary systems for the internal combustion engines of such vehicles, and relates to a multifunctional module, a motor vehicle comprising such a module and a process for manufacturing such a module.

BACKGROUND OF THE INVENTION

At present, the space available under the engine bonnet of vehicles is ever more restricted, particularly around the engine block, and tends to favour integration of the functions to be carried out with a view to reducing size, while maintaining their quality and performance longevity, on which the vehicle's operational reliability depends.

In addition, in terms of developing and manufacturing internal combustion engine vehicles, the current trend is no longer to think in terms of isolated elements, namely components or parts, but in terms of assemblies, units or modules, each fulfilling an overall function or several interdependent functions.

This is particularly the case for functions connected simultaneously to the engine cooling circuit and the recirculation or reinjection of exhaust gases (EGR).

It would of course be advantageous, for reasons of compactness and size reduction, as well as for reasons of reducing the number of parts and assembly and fitting operations, to integrate, for example, at least some of the functions of regulation and distribution of the coolant liquid when it leaves the engine block with the cooling function of the gases to be recycled, to achieve a single structural unit fulfilling these various functions.

In addition, if such a unit could also incorporate conduit portions of the respective circulation circuits, it would be possible to reduce still further the number of separate parts needed, as well as the length of the corresponding circuits, allowing, for example, rapid warming of the engine to be achieved after a cold start.

Moreover, to achieve a compact installation that does not require a particular support structure to retain it under the vehicle's bonnet, it would be useful to fix such a unit directly on the engine block.

Finally, it is also advantageous, for economic reasons, to produce at least certain constituent parts of such a unit in a plastics material, which must however be protected against too high temperatures.

SUMMARY OF THE INVENTION

The object of the present invention is to meet at least some of the expectations stated above, some of which are contradictory in terms of requirements.

Accordingly, the main object of the present invention is a multifunctional module is for internal combustion engines, forming a structural assembly and incorporating the functions of exhaust gas cooling and the at least partial regulation of circulation flows in the cooling circuit of said engine, a module characterized in that said structural assembly comprises a first functional unit incorporating, on the one hand, a part at least of an exhaust gas recirculation circuit and a heat exchanger for cooling said gases, preferably of elongated form, together with at least one gas flow regulation/diversion component, and, on the other hand, a part at least of the engine cooling circuit, with at least the water outlet casing and a thermostatic component for regulating the flow therein, and in that said structural assembly comprises a second functional unit in the form of a substantially flat plate-shaped body, forming a stiffening and fixing plate for the first functional unit and a thermal isolation interface between the first functional unit and the engine block, said plate-shaped body comprising on one of its faces sites for fitting and fixing the first functional unit and on the other face sites for fitting and fixing on the engine block.

BRIEF DESCRIPTION OF THE DRAWINGS

The invention will be better understood with the aid of the description below, which relates to a preferred embodiment, given as a non-limiting example, and explained with reference to the enclosed drawings, in which.

DETAILED DESCRIPTION OF THE INVENTION

Figure 1:
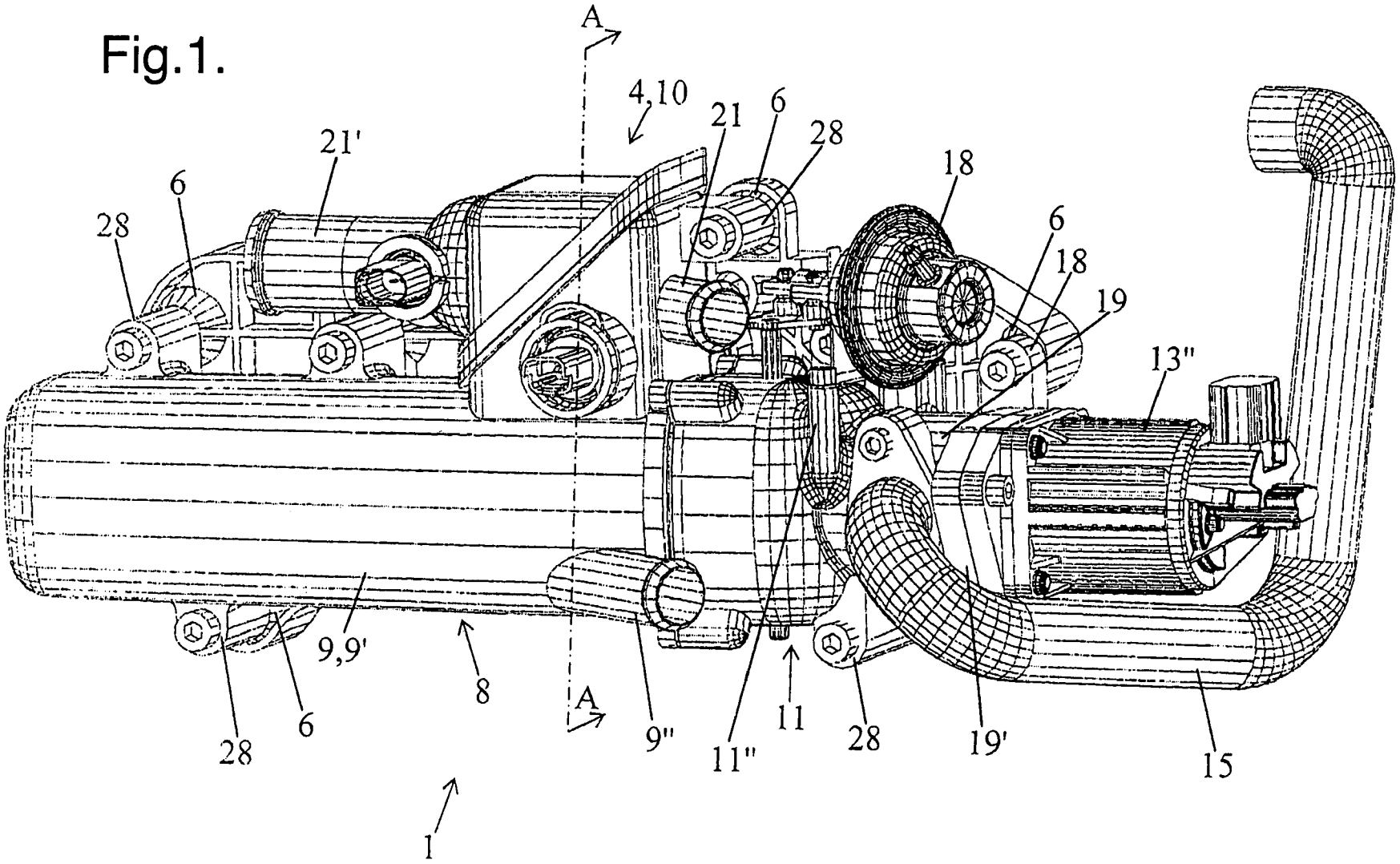
FIGS. 1 and 2 are views in perspective from two different angles of a functional module according to the invention.
Figure 2:
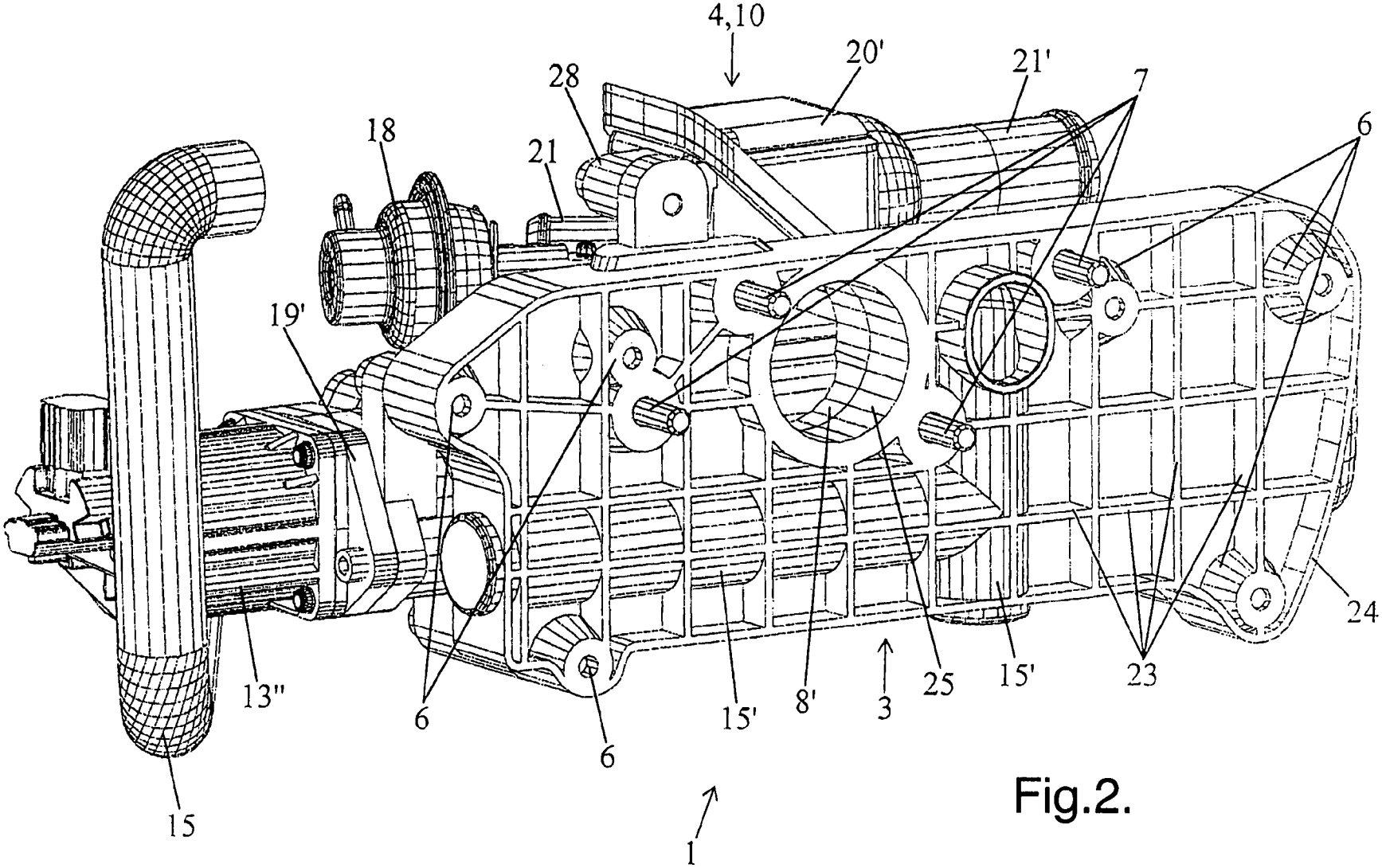
Figure 3:
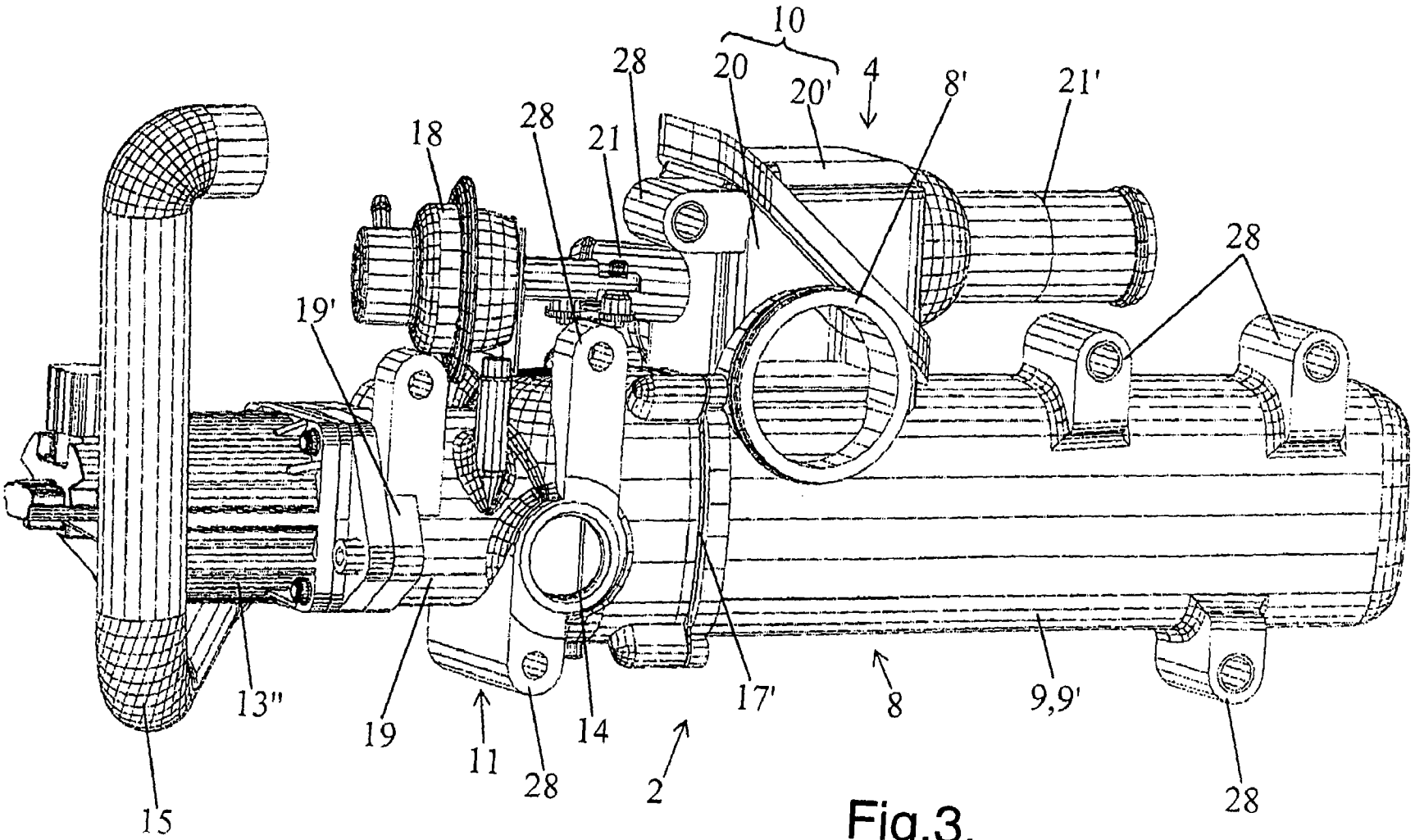
FIG. 3 is a view in perspective similar to the one in FIG. 2 showing the first functional unit, the second functional unit having been removed.
Figure 4:
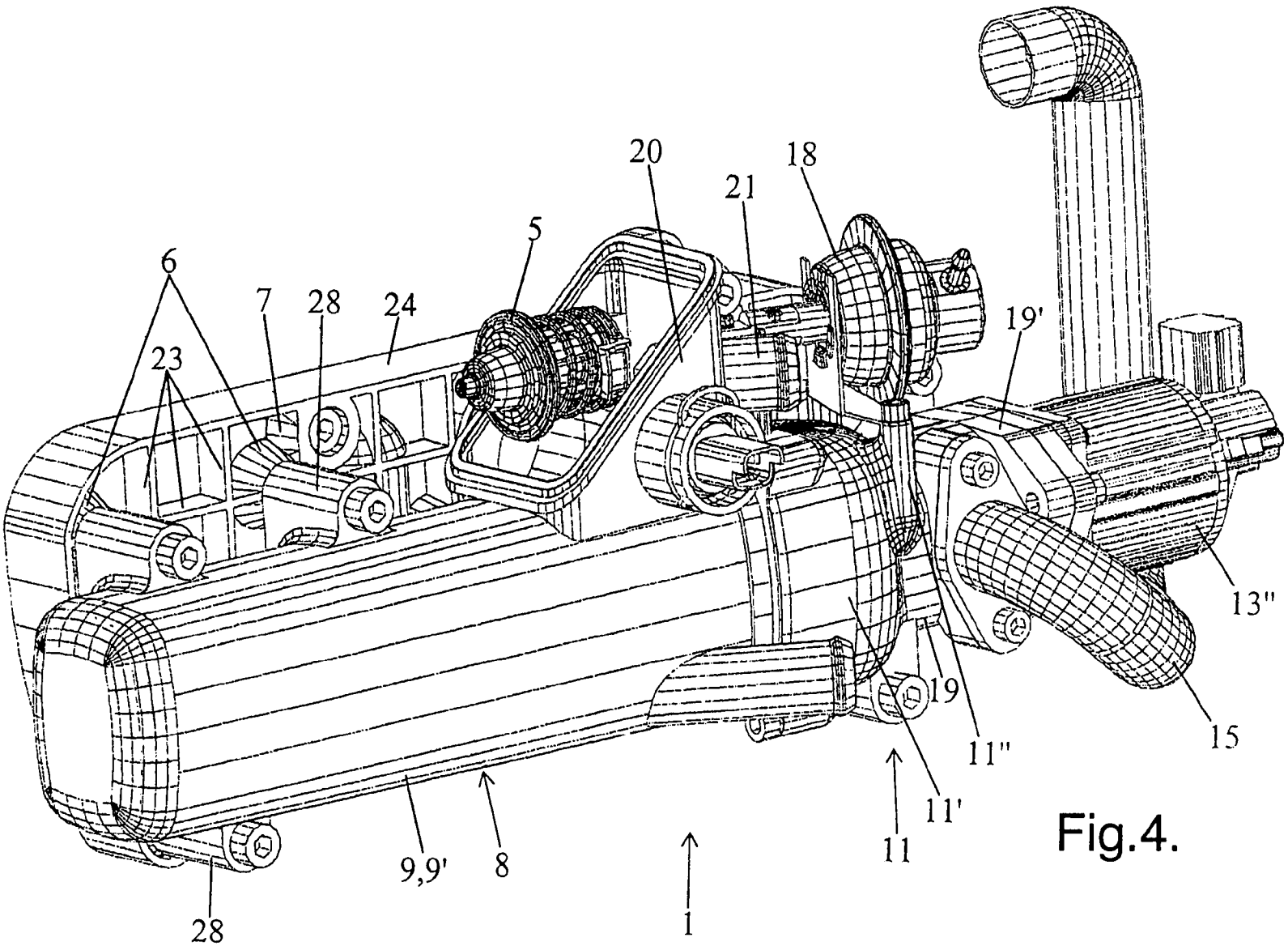
FIG. 4 is a view in perspective of the functional module in FIGS. 1 and 2, a part of the water outlet casing having been removed.

FIGS. 1, 2 and 4 show a multifunctional module 1 for an internal combustion engine, forming a structural assembly and incorporating the functions of exhaust gas cooling and of regulation, at least in part, of the circulation flows in the cooling circuit of said engine.

This module 1 is characterized in that said structural assembly comprises a first functional unit 2 incorporating, on the one hand, a part at least of an exhaust gas recirculation circuit and a heat exchanger for cooling said gases, preferably of elongated form, together with at least one component 13, 13' for regulating/diverting the gas flow, and, on the other hand, a part at least of the engine cooling circuit, with at least the water outlet casing 4 and a thermostatic component 5 for regulating the flow therein, and in that said structural assembly comprises a second functional unit 3 in the form of a substantially flat plate-shaped body, forming a stiffening and fixing plate for the first functional unit 2 and a thermal isolation interface between the first functional unit and the engine block, said plate-shaped body 3 comprising on one of its faces sites 6 for fitting and fixing the first functional unit and on the other face sites 7 for fitting and fixing on the engine block.

With the aid of the arrangements set out above, a compact multifunctional module 1 is achieved that can be fixed directly on the engine block without being subject to the constraints of a particular location imposed by the fixing and anchoring points of the first functional unit 2, the second functional unit 3 making it possible to mutually offset the fixing sites 6 and 7 respectively present on the two faces of said plate-shaped body forming this unit or body 3. In addition, given the thermal isolation introduced by this body 3, associated possibly with a particular circulation of the coolant liquid, it is possible to produce at least part of the first functional unit 2 in a non-metallic material.

According to a first characteristic of the invention, brought out particularly in FIGS. 1 to 5 of the accompanying drawings, the first unit 2 is substantially composed by assembly, on the one hand, of a first part 8 in plastics material comprising principally a first hollow body 9 forming a part at least of the tank 9' of the heat exchanger and a second hollow body 10 forming the water outlet casing 10, these two bodies 9 and 10 being adjacent and in fluidic communication, on the other hand, a second part 11 in a metallic material forming an exhaust gas distribution chamber 12, incorporating at least one gas flow regulation and/or diversion component 13, 13' and comprising inlet and outlet openings 14, 14' connected respectively to conduits 15, 15' forming the circulation circuit of said gases and, finally, a bundle of tubes 16, the majority of which are situated in the first hollow body 9 of the first part 8 and of which the inlet and outlet end portions 16' open into said distribution chamber 12, said bundle of tubes 16 being positioned and mounted in said first hollow body 9 by means of a support body 17 thus forming with it the heat exchanger, said support body 17 also providing a seal in the region of the assembly interface between said first hollow body 9 and the second part 11 in metallic material and closing the tank 9' of the exchanger.

Figure 5:
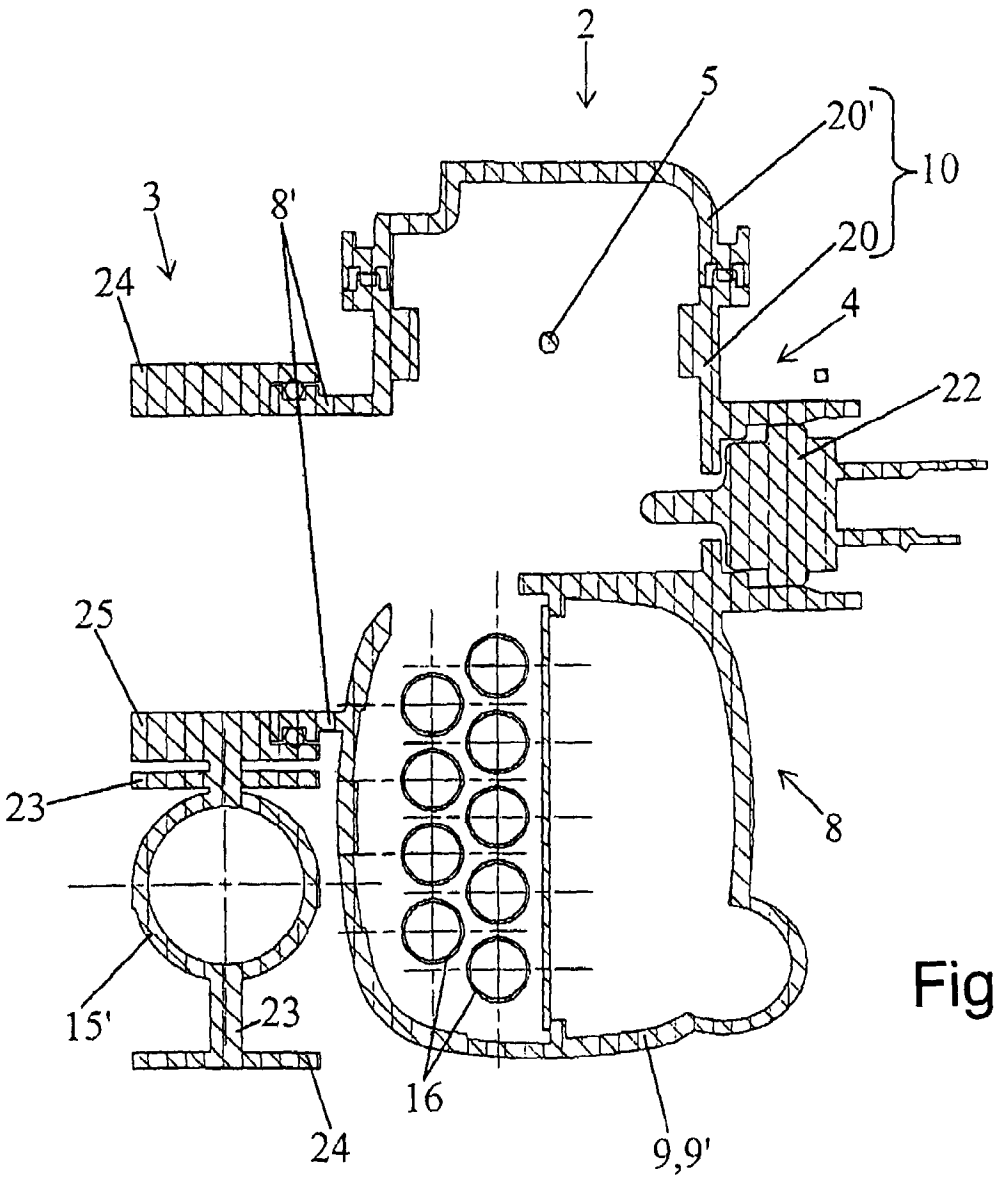
FIG. 5 is a view in section along A—A of the module illustrated in FIG. 1.
Figure 6:
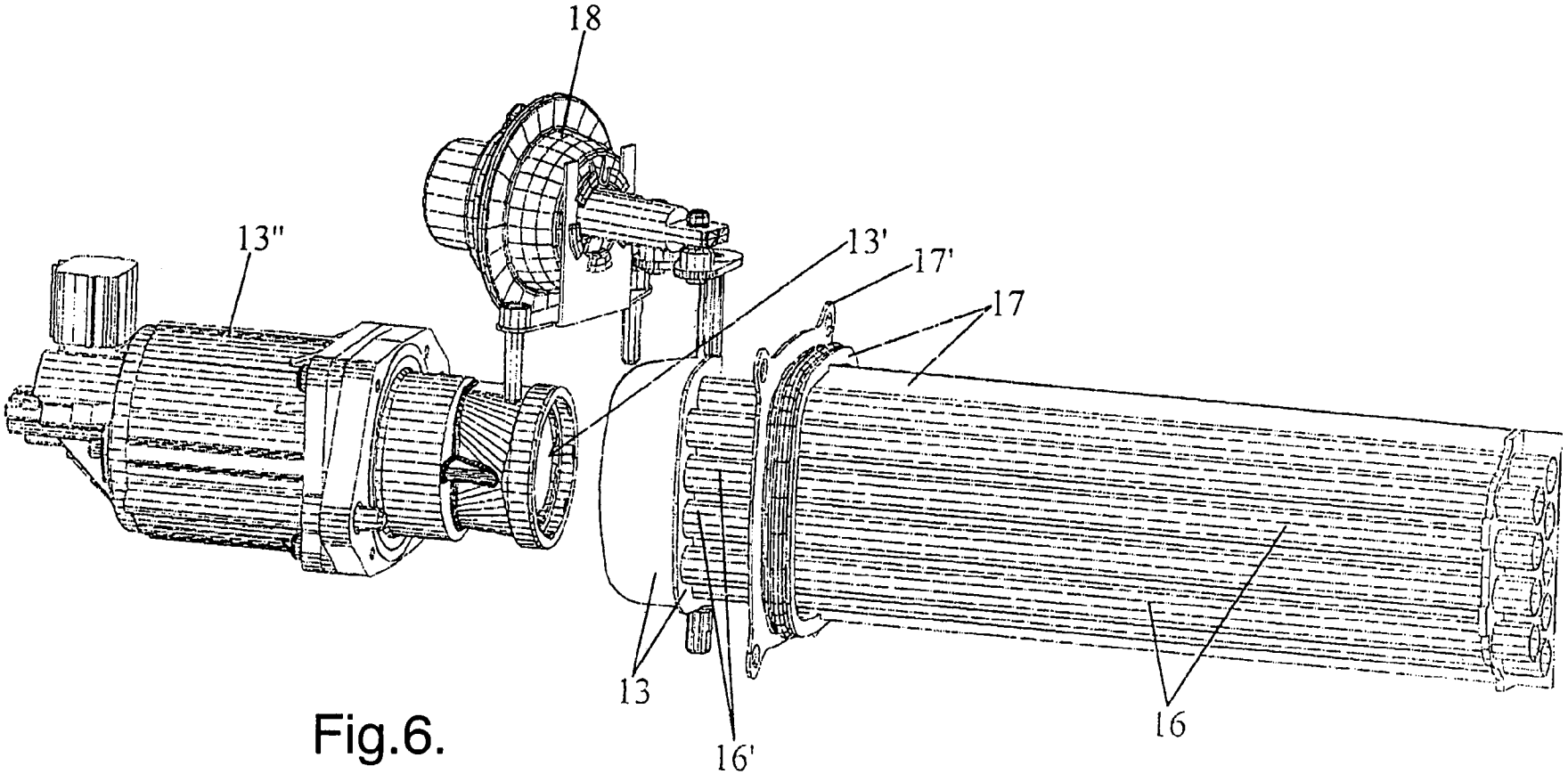
FIG. 6 is a transparent view in perspective showing the internal elements of the exchanger and the second metallic part of the first functional unit, forming part of the module according to the invention.

With a view to organising the circulation of gases in the second part 11 and controlling its degree of cooling, the exhaust gas distribution chamber 12 contains a regulation component 13 in the form of a valve controlling the admission of gases in the region of the openings of the inlet end portions 16' of the tubes 16 of the exchanger, preferably U-shaped, the position of said component 13 being determined by an actuator 18 outside said chamber 12. In addition, said distribution chamber 12 also comprises a regulation component 13, for example in the form of a flap gate or the like, controlling quantitatively the flow of exhaust gases admitted into said chamber 12 by the inlet opening 14 (FIGS. 5 and 6).

The regulation component 13 will thus control the rate of more or less cooled exhaust gas reinjected by means of the conduit 15 into the inlet manifold (not illustrated).

The actuator 18, for example of the electric or hydraulic type, may advantageously be mounted on or at least supported by one of the two units 2 or 3, by means of a support part that is attached or formed in a single piece.

According to a preferred embodiment, and as shown in FIGS. 1 to 3 and 10 of the accompanying drawings, the second part 11 has a generally bell-shaped structure and is assembled with the hollow body 9 forming the elongated tank of the first part 8 in the region of an opening in said body 9 through which pass the inlet and outlet end portions 16' of the tubes 16 of the exchanger, one part 17' in the form of a flat frame of the body 17 supporting the bundle of tubes 16 being sandwiched between the assembly edges of the second part 11 and said first hollow body 9 of the first part 8.

Figure 10:
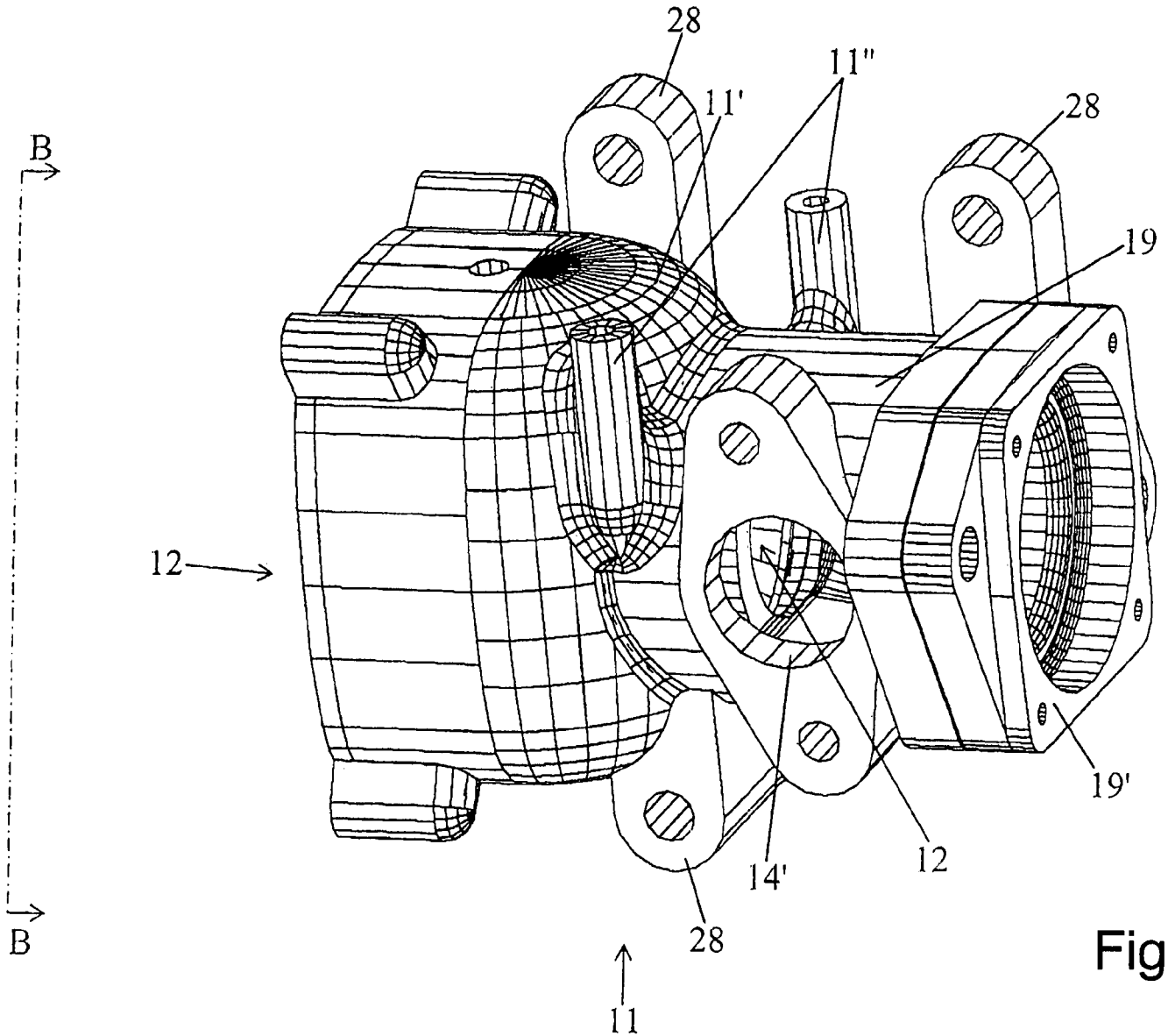
FIG. 10 is a view in perspective of a second metallic part forming part of the first functional unit of a module as illustrated in FIGS. 1, 2 and 4.
Figure 11:
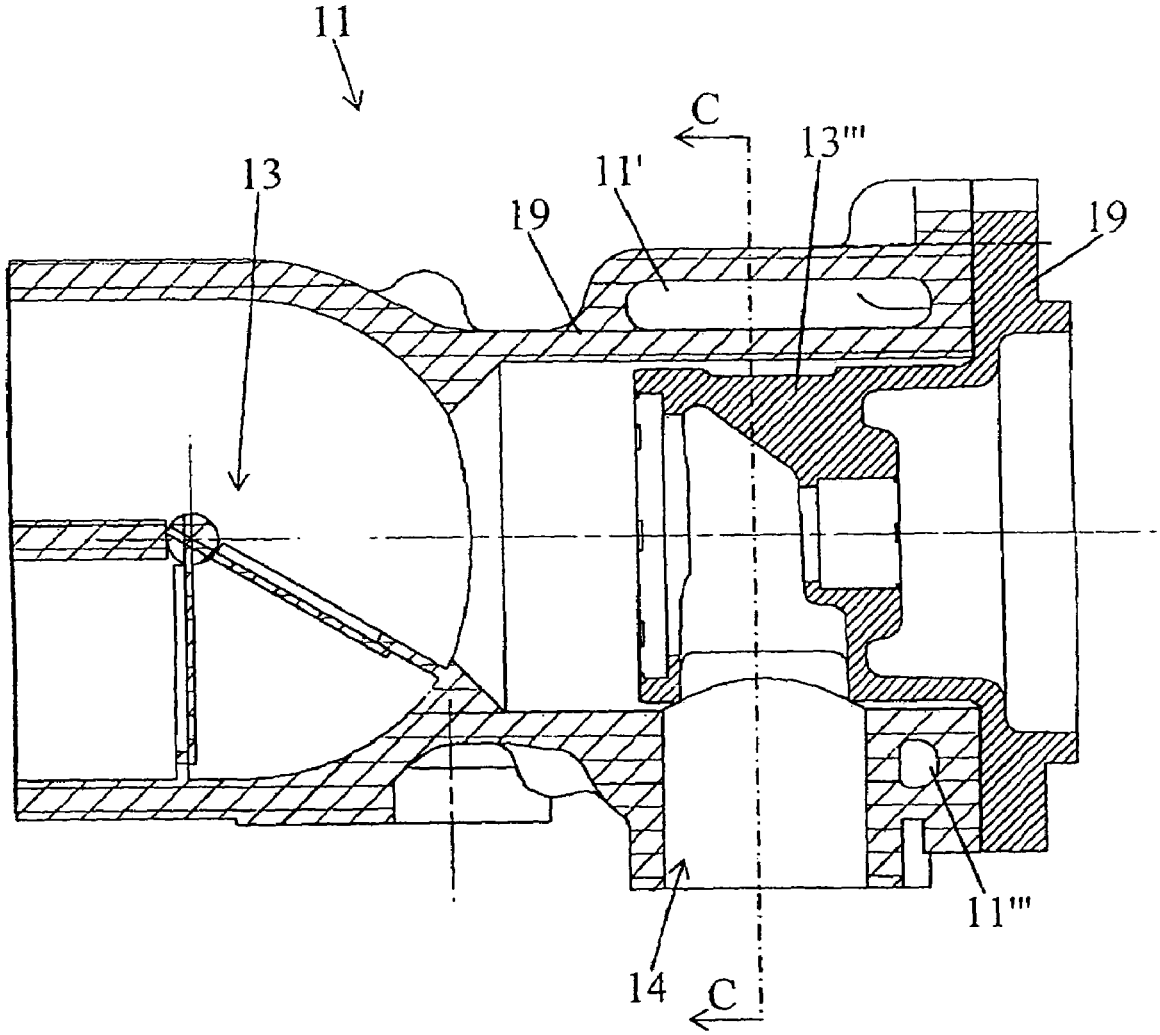
FIG. 11 is a view in longitudinal section along B—B of the second metallic part illustrated in FIG. 10.
Figure 12:
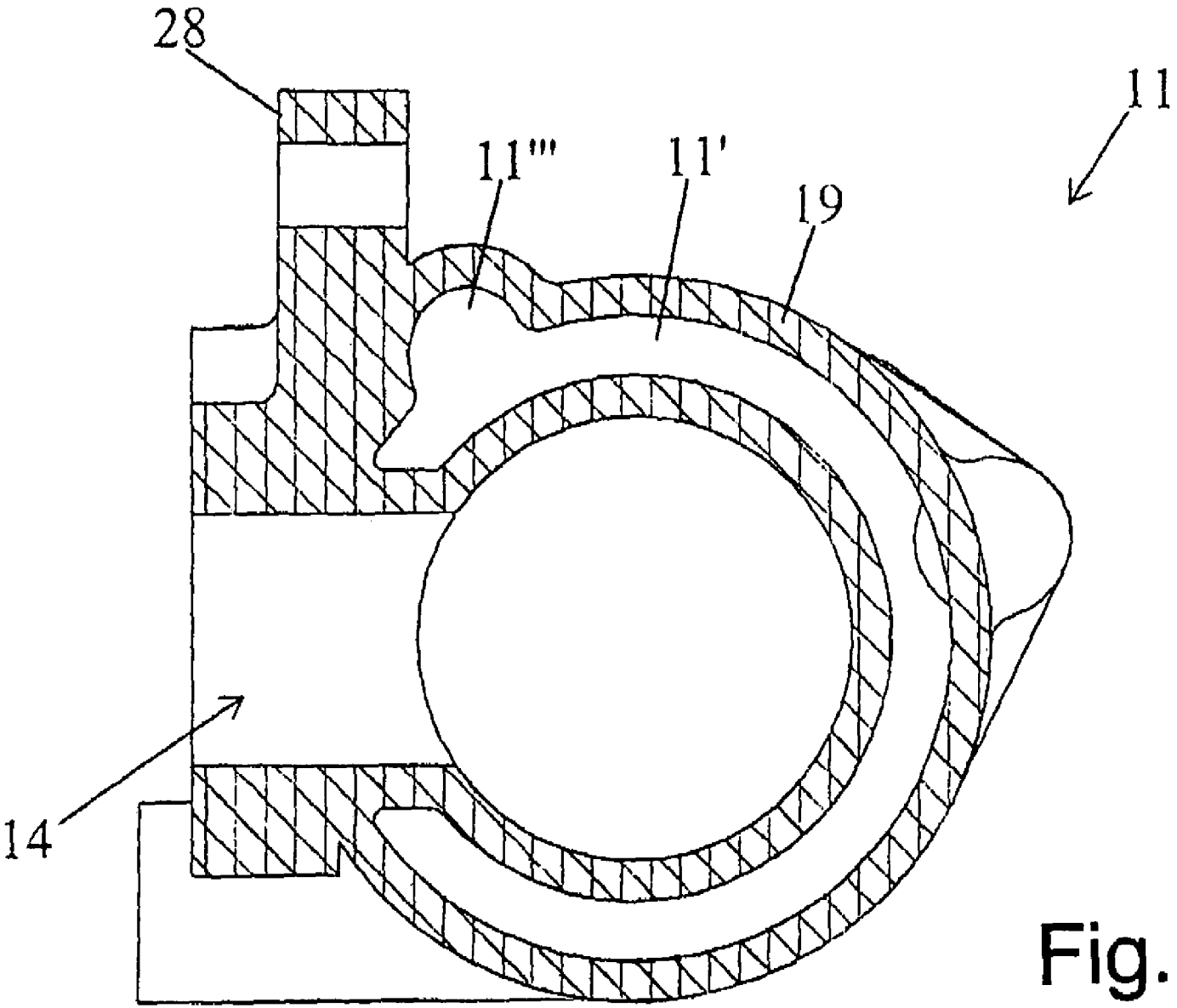
FIG. 12 is a view in section along C—C of the object of FIG. 11.

With a view to avoiding too great a rise in temperature due to the exhaust gases from the engine directly admitted into it, provision may advantageously be made for the second metallic bell-shaped part 11 to have, at least in part, a double wall 11' with an intermediary interstice and/or a plurality of canals 11''' embedded in its thickness and/or attached, delimiting a coolant liquid circulation space, supply and discharge opening(s) or endpiece(s) 11" for said liquid being formed on or arranged in said second part 11, and for said bell-shaped second part 11 to have a tubular portion 19 in which are arranged exhaust gas inlet 14 and outlet 14' openings and which comprises an opening with a mounting site 19 for the actuator 13" of a regulation component 13' controlling quantitatively the flow of exhaust gases admitted into said chamber 12 through said inlet opening 13' (FIGS. 10 to 12). The body 13''' of the component 13' can be seen in FIG. 11.

To facilitate manufacture of the second hollow body 10 and allow the installation of at least one internal regulation component, said second hollow body 10 of the first part 8 forming the envelope of the water outlet casing 4 consists of two parts 20 and 20' assembled together, for example by vibration welding, a first part 20 being formed in a single piece with the first hollow body 9, while possibly comprising a liquid inlet or outlet endpiece 21, and the second attached part 20' possibly being formed in a single piece with a water outlet endpiece 21', said water outlet casing 4 also comprising mounting sites for a thermostatic component 5 for regulating the flow of liquid discharged by the water outlet endpiece 21' and a temperature sensor 22 in contact with the interior volume of said water outlet casing 4 (FIGS. 1 to 5).

The first hollow body 9 forming the tank of the exchanger may comprise a liquid outlet endpiece 9" formed in a single piece, allowing said liquid to be sent towards a fan convector.

Figure 7:
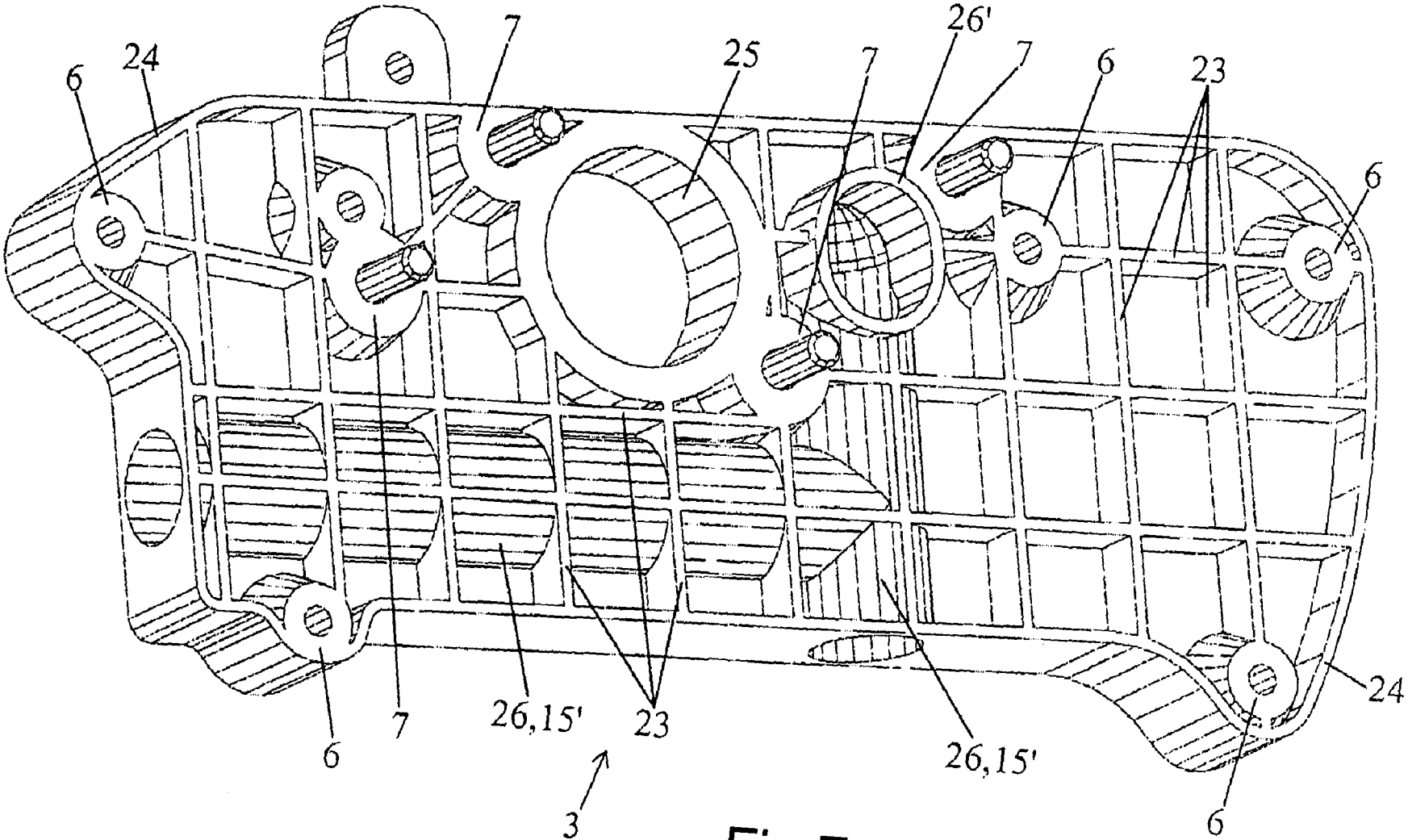
FIGS. 7 and 8 are views in perspective of the two faces of the second functional unit forming a plate-shaped body and forming part of the module according to the invention.
Figure 8:
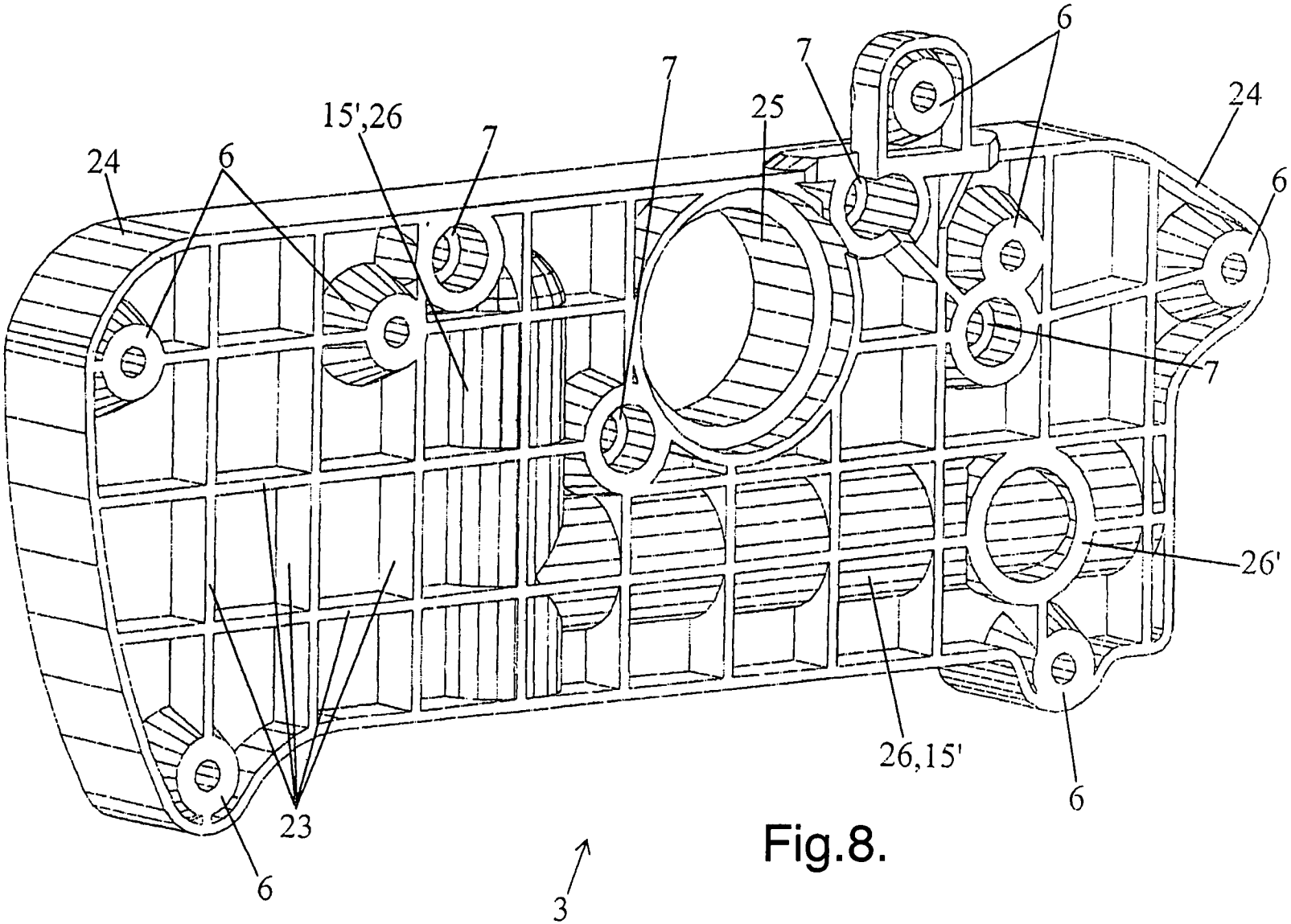
Figure 9:
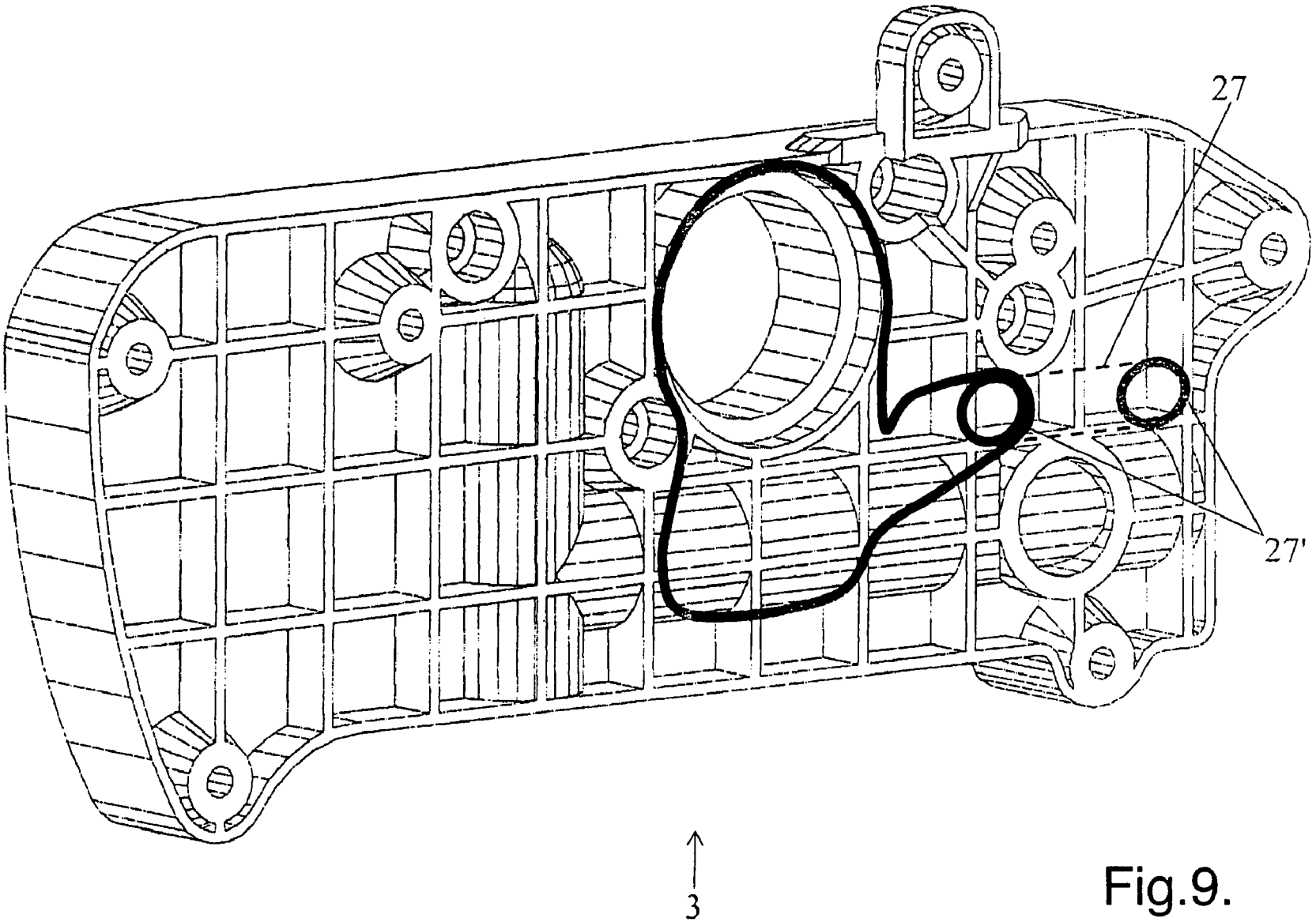
FIG. 9 is a view in perspective of a plate-shaped body according to a variant embodiment of the invention showing diagrammatically the production of a conduit portion in this body for circulating the coolant liquid.

According to a very advantageous characteristic of the invention, the substantially flat, plate-shaped body 3 consists of a metallic material comprising fitting and fixing sites 6 and 7 offset on one face in relation to the other, and has a rigid openwork structure similar to a lattice or grating consisting of a network of ribs in the form of rigid bands of material, preferably flat, interlaced in two dimensions, situated on edge in relation to the plane of the plate-shaped body 3 and delimited by a peripheral frame 24, also formed advantageously by a band of material situated on edge, so as to form a substantially hollow plate of a determined thickness, the fixing and fitting sites 6 and 7 being incorporated into said openwork structure, that structure being formed in a single piece, for example by moulding (FIGS. 7 to 9).

By using such a body 3 of cell-like or open-meshed structure, it is possible to achieve an optimal compromise between a rigid structure, a reduced amount of constituent material, an effective thermal screen and a large useful surface.

Such a meshed rigid structure allows a shaft of isolating air to be created, the sections of thermal bridges to be limited, the ribs to be cooled by allowing the circulation of air in the region of their open parts and a large dissipation surface to be provided.

Advantageously, the openwork structure forming the plate-shaped body 3 incorporates at least one portion of tubular conduit 25 extending perpendicularly to the plane of said body 3 and connecting, when module 1 is fitted, the outlet of the engine block's internal coolant liquid circulation circuit to an admission opening or endpiece 8' common to the two hollow bodies 9, 10 forming the first part 8 (FIGS. 2, 3, 5, 7 to 9). It is thus possible to eliminate a separate conduit portion and shorten the length of that portion of the coolant liquid circulation circuit to the maximum.

With a view to reducing still further the number of conduit segments needed to form the coolant liquid circulation and/or exhaust gas recirculation circuits, thus reducing the size of said circuits and taking advantage of the nature and properties of the constituent material and of the structure of the body 3, the flat openwork structure forming the plate-shaped body 3 incorporates at least one portion of conduit or tube 26, 27 extending in the thickness of said structure and connecting at least two openings 26', 27' to each other, inlet and outlet respectively, each opening onto one of the two opposite faces of the plate-shaped body 3 or both on the same face thereof (FIGS. 2, 5, 7 to 9).

This or these tube portion(s) 26, 27 will consist advantageously of communicating association of straight conduit segments opening to the exterior in the region of the peripheral frame 24 (sealing the emission holes with plugs), in order to allow the body 3 to be manufactured by moulding.

According to a first variant embodiment of the invention, brought out particularly in FIGS. 7 and 8 of the accompanying drawings, the flat openwork structure incorporates at least one portion of conduit or tube 26 forming part of the exhaust gas recirculation circuit and connecting, for example, the engine block's exhaust gas outlet to the gas inlet opening 14 of the distribution chamber 12 of the second part 11.

According to a second variant embodiment, brought out in FIG. 9 of the accompanying drawings, the flat openwork structure incorporates at least one portion of conduit or tube 27 forming part of the engine block's coolant circuit, said portion of conduit or tube being preferably connected or in fluidic communication with the tubular conduit portion 25 crossing said structure transversely.

This incorporated conduit portion 27 could possibly serve to supply coolant liquid to the interstice of the double wall 11' of the part 11 and/or the canals 11" thereof.

Provision may of course also be made for said body 3 to incorporate at the same time portions of circulation conduit for the coolant liquid 27 and for the exhaust gases 26, separated from each other and each comprising its own openings (not illustrated).

Moreover, provision may also be made for the body 3 to incorporate conduit portions for circulating coolant liquid with a view to cooling said body.

As also shown in the figures of the accompanying drawings, the first and second parts 9 and 11 of the first functional unit 2 comprise fixing sites 28, for example in the form of eyelets or lugs, formed in a single piece for assembly with the corresponding fitting and fixing sites 6 of the second functional unit 3 in the form of a plate-shaped body.

The invention also relates to a motor vehicle comprising an internal combustion engine, characterized in that it comprises a multifunctional module as described above.

Finally, the invention also relates to a process for manufacturing such a module, characterized in that it consists of producing the first part 8, the second part 11 and the plate-shaped body 3 separately, then assembling the first part 8 with the second part 11, for example by means of nut and bolt units and, finally, fitting and fixing, for example by means of screws, the first functional unit 2 thus formed on the plate-shaped body 3.

Of course, the invention is not limited to the embodiments described and illustrated in the accompanying drawings. Modifications are possible, particularly from the point of view of the composition of the various elements or by substitution of technical equivalents, without thereby departing from the scope of protection of the invention.

The present disclosure relates to subject matter contained in French Application No. 0409923, filed on Sep. 20, 2004, the contents of which are herein expressly incorporated by reference in its entirety.

The invention claimed is:

1. A multifunctional assembly for an internal combustion engine comprising:

a first assembly having at least a part of an exhaust gas recirculation circuit provided therein, a heat exchanger configured to cool a gas, at least one gas flow regulator which regulates a flow of gas, and a water outlet casing having a thermostatic component which regulates a flow of water inside of the water outlet casing;

a second assembly having a generally flat plate-shaped body which forms a stiffening and fixing plate of the multifunctional assembly, wherein the second assembly forms a thermal isolation interface provided between the first assembly and an engine block of the internal combustion engine, wherein one face of the second assembly is provided with first sites which fix the first assembly to the second assembly, and wherein another face of the second assembly is provided with second sites which are configured to fix the second assembly to the engine block;

a first hollow body which forms at least part of a tank of the heat exchanger;

a second hollow body which forms at least a part of the water outlet casing;

an exhaust gas distribution chamber having the gas flow regulator provided therein and first, the exhaust gas distribution chamber having inlet and outlet openings connected to respective conduits which form the exhaust gas recirculation circuit;

a plurality of tubes having tube inlets and outlets and being situated in the first hollow body;

wherein the first and second hollow bodies are adjacent and in fluid communication with each other; and wherein the tube inlets and outlets are in fluid communication with the exhaust gas distribution chamber.

2. The multifunctional assembly according to claim 1, wherein the gas flow regulator is a valve which controls the admission of gases in a region of the openings of the tube inlets, and wherein a position of the valve is determined by an actuator provided outside of the exhaust gas distribution chamber.

3. The multifunctional assembly according to claim 1, wherein the second hollow body comprises two parts assembled together, wherein one of the two parts is formed in a single piece with the first hollow body, wherein the other of the two parts is formed in a single piece with a water outlet endpiece which is connected to the water outlet casing, wherein the water outlet casing comprising a mount which mounts the thermostatic component and a temperature sensor in communication with an interior space of the water outlet casing.

4. The multifunctional assembly according to claim 1, wherein the second assembly comprises a metallic material and at least two faces configured to fix the second assembly to both the first assembly and the engine block, wherein one of the at least two faces has fixing and fitting sites which are offset from fixing and fitting sites provided on another of the at least two faces, wherein the second assembly has a generally flat openwork structure including ribs interlaced in two-dimensions.

5. The multifunctional assembly according to claim 1, wherein the exhaust gas distribution chamber is generally bell-shaped and assembled with the first hollow body, and a generally flat support body which is sandwiched between the edges of the exhaust gas distribution chamber and the first hollow body.

6. The multifunctional assembly according to claim 5, wherein the bell-shape of the exhaust gas distribution chamber comprises a double wall having one of an intermediary interstice and a plurality of canals in at least one of embedded in and attached to the double wall, wherein either one of the intermediary interstice and the plurality of canals delimits a coolant liquid circulation space, wherein supply or discharge openings configured to receive liquid are provided in the exhaust gas distribution chamber, wherein the exhaust gas distribution comprising an opening having a mount which mounts the actuator.

7. A multifunctional assembly for an internal combustion engine comprising:

a first assembly having at least a part of an exhaust gas recirculation circuit provided therein, a heat exchanger configured to cool a gas, at least one gas flow regulator which regulates a flow of gas, and a water outlet casing having a thermostatic component which regulates a flow of water inside of the water outlet casing; and a second assembly having a generally flat plate-shaped body which forms a stiffening and fixing plate of the multifunctional assembly, wherein the second assembly forms a thermal isolation interface provided between the first assembly and an engine block of the internal combustion engine, wherein one face of the second assembly is provided with first sites which fix the first assembly to the second assembly, and wherein another face of the second assembly is provided with second sites which are configured to fix the second assembly to the engine block.

8. A motor vehicle comprising the multifunctional assembly according to claim 7.

9. The multifunctional assembly according to claim 7, further comprising:

a first hollow body which forms at least part of a tank of the heat exchanger;

a second hollow body which forms at least a part of the water outlet casing;

an exhaust gas distribution chamber having the gas flow regulator provided therein and first, the exhaust gas distribution chamber having inlet and outlet openings connected to respective conduits which form the exhaust gas recirculation circuit;

a plurality of tubes having tube inlets and outlets and being situated in the first hollow body;

a support body which mounts the plurality of tubes inside of the first hollow body to form the heat exchanger;

wherein the first and second hollow bodies are adjacent and in fluid communication with each other; and wherein the tube inlets and outlets are in fluid communication with the exhaust gas distribution chamber.

10. The multifunctional assembly according to claim 9, wherein the second hollow body comprises two parts assembled together, wherein one of the two parts is formed in a single piece with the first hollow body, wherein the other of the two parts is formed in a single piece with a water outlet endpiece which is connected to the water outlet casing, wherein the water outlet casing comprising a mount which mounts the thermostatic component and a temperature sensor in communication with an interior space of the water outlet casing.

11. The multifunctional assembly according to claim 9, wherein the first sites of the first assembly includes one of eyelets and lugs formed unitarily with the first assembly and corresponding to the second sites of the second assembly.

12. A process for manufacturing the multifunctional assembly of claim 9, comprising producing the first and second hollow bodies separately from the exhaust gas distribution chamber, and assembling the hollow bodies and the exhaust gas distribution chamber.

13. The multifunctional assembly according to claim 9, wherein the first and second hollow bodies comprise a plastic material.

14. The multifunctional assembly according to claim 9, wherein the exhaust gas distribution chamber comprises a metal material.

15. The multifunctional assembly according to claim 9, wherein the exhaust gas distribution chamber is generally bell-shaped and assembled with the first hollow body, and wherein the support body is a generally flat frame which is sandwiched between the edges of the exhaust gas distribution chamber and the first hollow body.

16. The multifunctional assembly according to claim 15, wherein the bell-shape of the exhaust gas distribution chamber comprises a double wall having one of an intermediary interstice and a plurality of canals in at least one of embedded in and attached to the double wall, wherein either one of the intermediary interstice and the plurality of canals delimits a coolant liquid circulation space, wherein supply or discharge openings configured to receive liquid are provided in the exhaust gas distribution chamber, wherein the exhaust gas distribution comprising an opening having a mount which mounts the actuator.

17. The multifunctional assembly according to claim 9, wherein the gas flow regulator is a valve which controls the admission of gases in a region of the openings of the tube inlets, and wherein a position of the valve is determined by an actuator provided outside of the exhaust gas distribution chamber.

18. The multifunctional assembly claim depending from 17, wherein the valve is a generally u-shaped valve.

19. The multifunctional assembly claim depending from 17, wherein the valve is in the form of a flap gate which controls the flow of exhaust gases admitted into the exhaust gas distribution chamber by the inlet opening.

20. The multifunctional assembly according to claim 9, wherein the second assembly comprises a metallic material and at least two faces configured to fix the second assembly to both the first assembly and the engine block, wherein one of the at least two faces has fixing and fitting sites which are offset from fixing and fitting sites provided on another of the at least two faces, wherein the second assembly has a generally flat openwork structure including ribs interlaced in two-dimensions.

21. The multifunctional assembly according to claim 20, wherein the openwork structure incorporates at least a portion of a tubular conduit which extends generally perpendicular to the plane of the second assembly and connects an outlet of an internal coolant liquid circulation circuit of the engine block to an admission opening of the first and second hollow bodies.

22. The multifunctional assembly according to claim 20, wherein the openwork structure incorporates at least a portion of a tubular conduit which extends in a thickness direction of the structure, and wherein the openwork structure connects at least two openings provided on either one of the one of the at least two faces and the another of the at least two faces.

23. The multifunctional assembly according to claim 22, wherein the at least one portion of the tubular conduit forms a part of the exhaust gas recirculation circuit which connects the exhaust gas outlet of the engine block to a gas inlet opening of the exhaust gas distribution chamber.

24. The multifunctional assembly according to claim 22, wherein the at least one portion of the tubular conduit forms a part of the internal coolant liquid circulation circuit of the engine block, and wherein at least one portion of the tubular conduit is one of connected to and in fluid communication with a second tubular conduit portion which extends traverse to the flat-shaped body of the second assembly.

* * * * *